US005459299A

United States Patent [19]

Cheng

[11] Patent Number: 5,459,299

[45] Date of Patent: Oct. 17, 1995

[54] CAR CIGARETTE LIGHTER WITH U-SHAPED ENGAGING MEANS

[76] Inventor: Yu-feng Cheng, No. 7, Fu Hsing Street, Tu Cheong Ind. Dist., Taipei Hsien, Taiwan

[21] Appl. No.: 300,329

[22] Filed: Sep. 2, 1994

[51] Int. Cl.[6] ..... F23Q 7/00

[52] U.S. Cl. ..... 219/267

[58] Field of Search ..... 219/260–270

[56] References Cited

U.S. PATENT DOCUMENTS

| | | | |
|---|---|---|---|
| 3,643,062 | 2/1972 | Ohinata | 219/265 |
| 3,955,333 | 5/1976 | Fellin | 403/13 |

FOREIGN PATENT DOCUMENTS

| | | | |
|---|---|---|---|
| 2518792 | 11/1976 | Germany | 219/267 |
| 625431 | 9/1961 | Italy | 219/267 |

*Primary Examiner*—John A. Jeffery

*Attorney, Agent, or Firm*—Kirkpatrick & Lockhart

[57] ABSTRACT

A car cigarette lighter is suitable to be received in different sizes of sockets each of which includes a positive pole and a negative pole therein. The car cigarette lighter includes a cylinder body, a neck extending from the cylinder body, a head extending from the neck. Four elongated grooves and four elongated ridges are alternately disposed with each other in a periphery of the cylinder body. Two elastic wings are formed at two opposite ridges. Two U-shaped engaging devices each including a pair of prongs are received in the four grooves, with each prong being received in a corresponding rear section of a corresponding elongated groove and leaving a front section of the groove unoccupied. Each U-shaped engaging device is slidable along the corresponding pair of elongated grooves. The lighter is inserted into the socket causing the head and the wings thereof to be respectively in electrical contact with the positive pole and the negative pole of the socket, and the U-shaped engaging devices are allowed to be pushed into the socket, thereby firmly engaging the lighter with the socket.

4 Claims, 4 Drawing Sheets

CAR CIGARETTE LIGHTER WITH U-SHAPED ENGAGING MEANS

BACKGROUND OF THE INVENTION

1. Field of the Invention

The present invention relates to a car cigarette lighter which is suitable to be firmly received in different sizes of sockets.

2. Description of the Prior Art

Most cars at the present time include a cigarette lighter installed at the instrument panel thereof. FIG. 5 illustrates a conventional cigarette lighter which is substantially constructed as a cylinder 90 comprising a fuse head 901 at one end for electrical contact to a positive pole of an electric socket (not shown) on the instrument panel. Two elastic wings 91 (only one is shown) are formed on the periphery of the cylinder 90 for electrically abutting against a negative pole of the electric socket when the cylinder 90 is inserted into the electric socket. Since different cigarette lighter sockets have different sizes, the engagement between the cigarette lighter and the socket depends on the elasticity of the two wings 91. Normally, if a socket has a relatively small radius, the engagement between the lighter and the socket is relatively stronger than that between the lighter and another socket having a relatively large radius. Since the engagement between the lighter and a socket is not guaranteed solid enough, the electrical contact between the fuse head 901 of the lighter and the positive pole of the socket may be loosened due to strong shaking of the car when it travels on a poorly conditioned road.

For improving the above drawback, another cigarette lighter is provided as shown in FIG. 6. This cigarette lighter comprises a cylinder body 80 which has a head 801 formed at one end thereof and two wings 81 formed on the periphery thereof. The lighter is inserted into a socket 82 which has a positive pole 83 fixed at a bottom thereof and a negative pole 84 formed circularly around an inner surface of the socket 82. The positive pole 83 of the socket 82 is U-shaped with two elastic prongs 830 slanted at an angle with respect to a bottom plate thereof for engaging with a neck 802 from which the head 801 extends. The head 801 of the lighter is in electrical contact with the positive pole 83 and the wings 81 are electrically in contact with the negative pole 84. It appears that the construction of the lighter is suitable for all kinds of the sockets which have the U-shaped positive pole, however, in practice, the neck 802 of the lighter may damage the U-shaped pole 83 which has relatively slanted prongs, i.e., the size of the neck 802 may be suitable for some U-shaped poles with some angular range in the prongs but not for other U-shaped pole with a different angular range in the prongs.

The present invention has arisen to mitigate and/or obviate the afore-described disadvantages of the conventional car cigarette lighter.

SUMMARY OF THE INVENTION

The primary objective of the present invention is to provide an improved car cigarette lighter which can remain in firm electrical contact with different sizes of electric sockets.

In accordance with one aspect of the invention, there is provided a car cigarette lighter which is suitable to be received in different sizes of sockets each of which includes a positive pole and a negative pole therein. The car cigarette lighter includes a cylinder body, a neck extending from the cylinder body, a head extending from the neck. Four elongated grooves and four elongated ridges are alternately disposed with each other in a periphery of the cylinder body. Two elastic wings are formed at two opposite ridges. Two U-shaped engaging devices each including a pair of prongs are received in the four grooves, with each prong being received in a corresponding rear section of a corresponding elongated groove and leaving a front section of the groove unoccupied. Each U-shaped engaging mean is slidable along the corresponding pair of elongated grooves. Each prong of the U-shaped engaging means has a tapering surface which has a front portion totally received in the elongated groove and a rear portion not totally received in the groove. The lighter is inserted into the socket causing the head and the wings thereof to be respectively in electrical contact with the positive pole and the negative pole of the socket, and the two U-shaped engaging means are pushed into the socket with the rear portion of the tapering surface of each prong being firmly engaged with the socket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
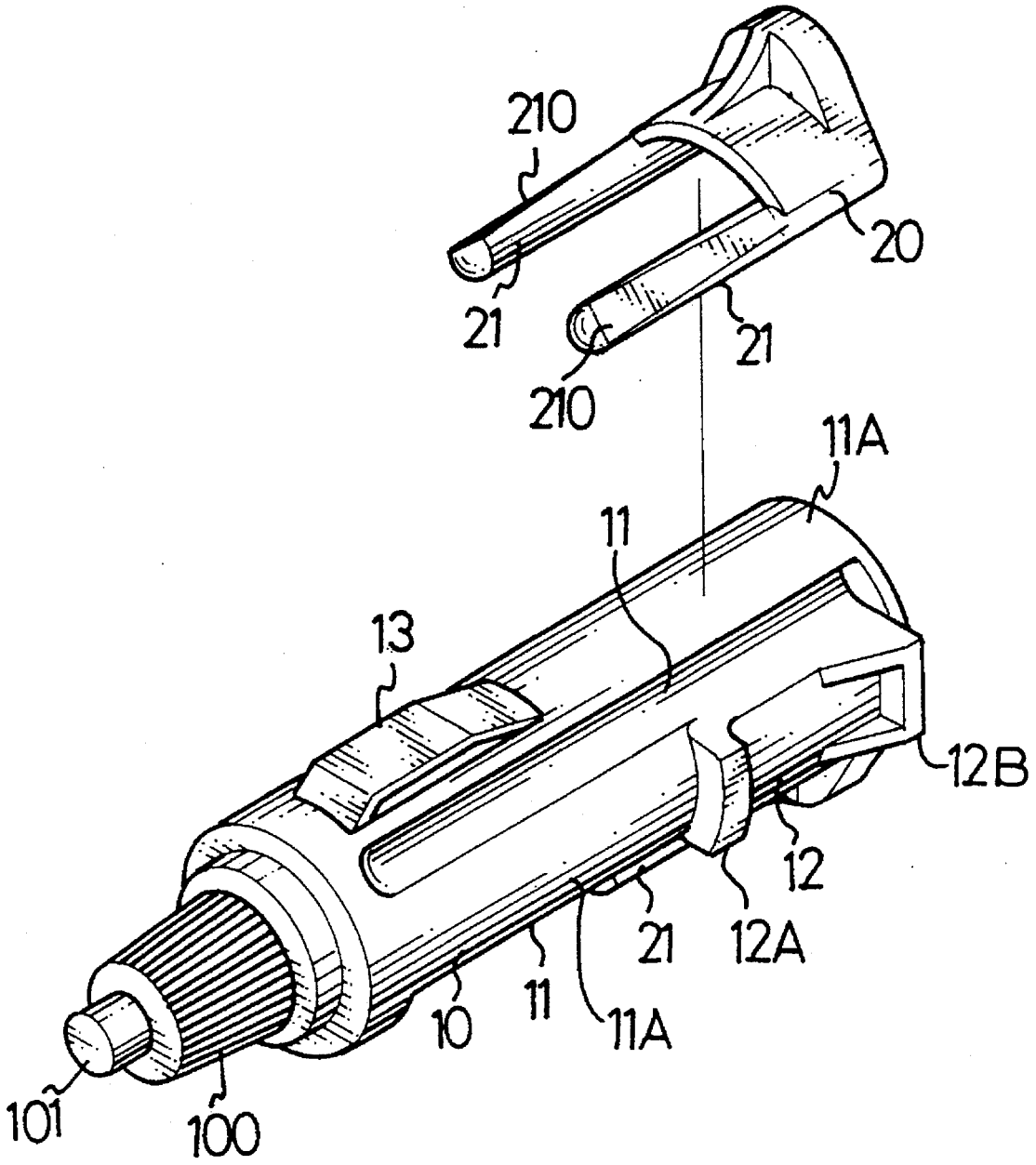
FIG. 1 is an exploded view of a car cigarette lighter in accordance with the present invention.
Figure 2:
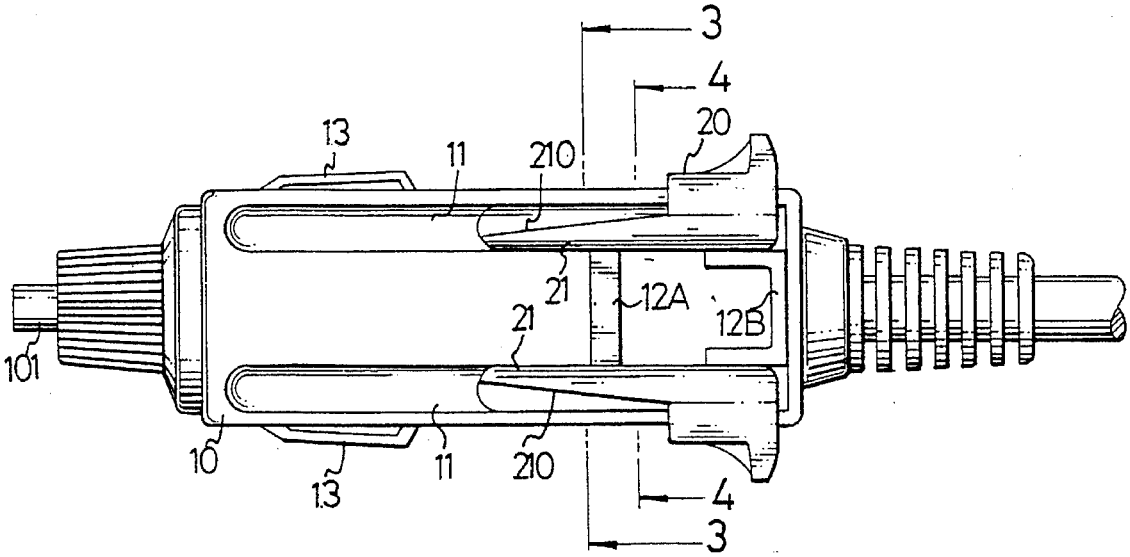
FIG. 2 is a side view of the car cigarette lighter.
Figure 4:
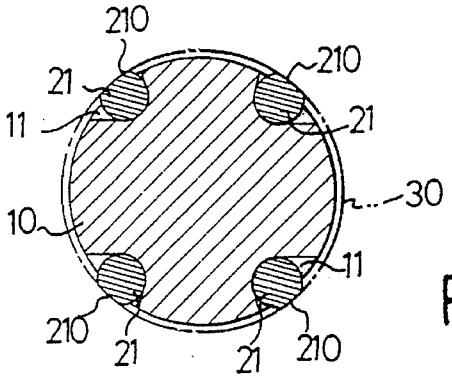
FIG. 4 is a schematic cross-sectional view of the car cigarette lighter received in an electric socket.
Figure 3:
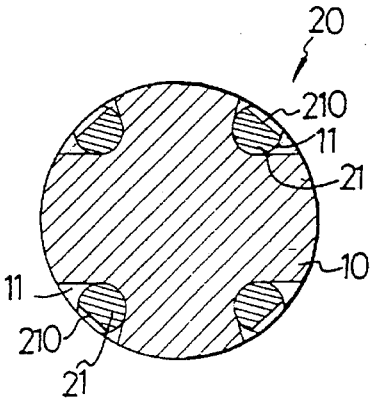
FIG. 3 is a cross-sectional view of the car cigarette lighter taken from a line 3—3 of FIG. 2.
Figure 6:
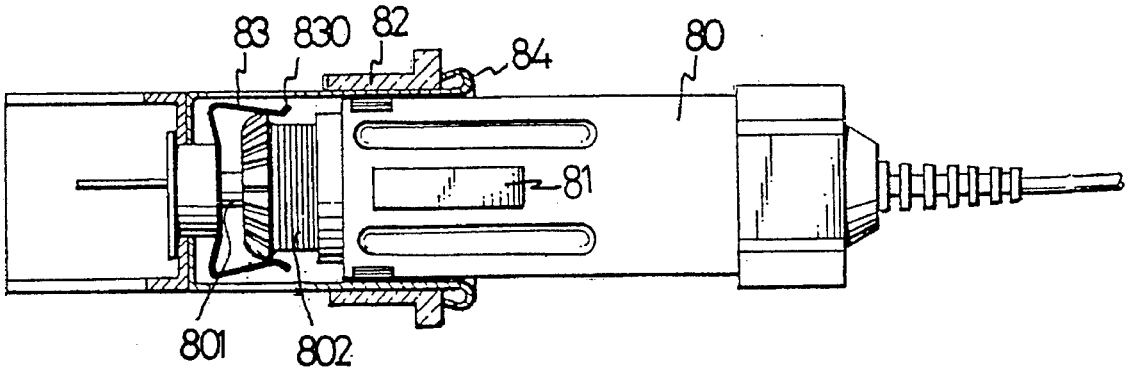
FIG. 6 PRIOR ART
FIG. 6 is another conventional car cigarette lighter inserted in an electric socket.
Figure 5:
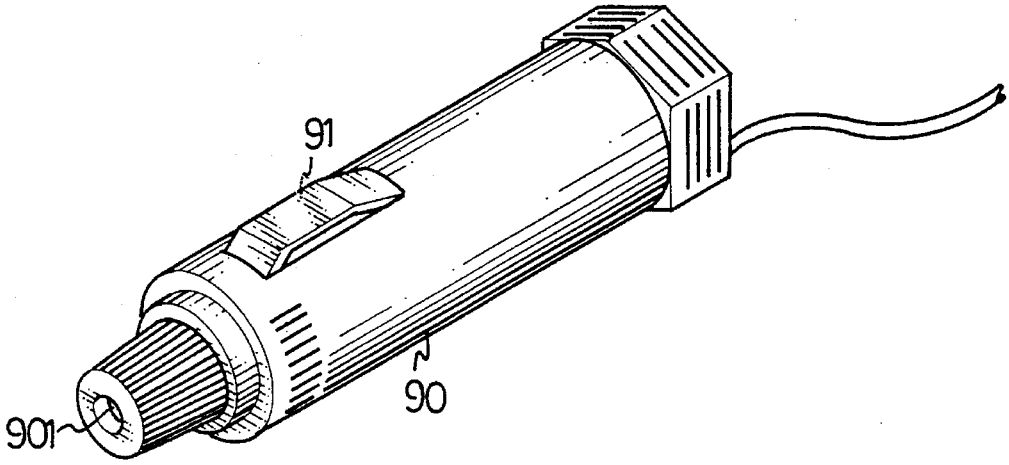
FIG. 5 PRIOR ART
FIG. 5 is a conventional car cigarette lighter.

Referring to FIGS. 1 and 2, a car cigarette lighter in accordance with the present invention comprises a cylinder body 10, a neck 100 extending from the cylinder body 10, and a head 101 extending from the neck 100. The cylinder body 10 defines four elongated grooves 11 and four elongated ridges 11A alternately disposed with each other in the periphery thereof. Two elastic wings 13 are formed at two opposite ridges 11A and near the neck 100. A first protrusion 12A and a second protrusion 12B are formed at two other ridges 11A near a rear end of the cylinder body 10 thus defining a handle position 12 between the first protrusion 12A and the second protrusion 12B allowing a user to hold thereon to insert the lighter into the socket 30. Two U-shaped engaging means 20 each includes a pair of prongs 21 each of which is received in a corresponding rear section of a corresponding elongated groove 11 and leaves a front section of the groove 11 unoccupied. Each U-shaped engaging means 20 is slidable along the corresponding pair of elongated grooves 11. Each prong 21 of the U-shaped engaging means 20 has a tapering surface 210 which has a front portion totally received in the elongated groove 11 (see FIG. 3) and a rear portion not totally received in the groove 11 (see FIG. 4). It is noted that the cross-sectional view in FIG. 3 is taken from the front portion of the prongs 21 of the U-shaped engaging means 20 together with the cylinder body 10, while the cross-sectional view in FIG. 4 is taken from a rear portion of the prongs 21 and a socket 30 is also included for illustrative purpose. Each U-shaped engaging means 20 is positioned at the rear portion of the elongated grooves 11 (see FIG. 2) when the cigarette lighter is inserted into the electric socket 30, thereafter, the user can push the U-shaped engaging means 20 into the socket 30 until he/she feels the engagement between the cigarette lighter and the socket 30 is strong enough. It is noted that the head 101 and the wings 13 of the lighter are respectively in electric contact with a positive pole and a negative pole of the socket 30 when the lighter is inserted into the socket 30. Pushing the U-shaped engaging means 20 into the socket 30 merely enforces the engagement between the lighter and the socket and does not affect the electrical contact between the lighter and the socket. Therefore, with the U-shaped engaging means 20, the cigarette lighter is allowed to be retained in firm engagement with the different sockets and will not damage the socket 30 during insertion.

Figure 7:
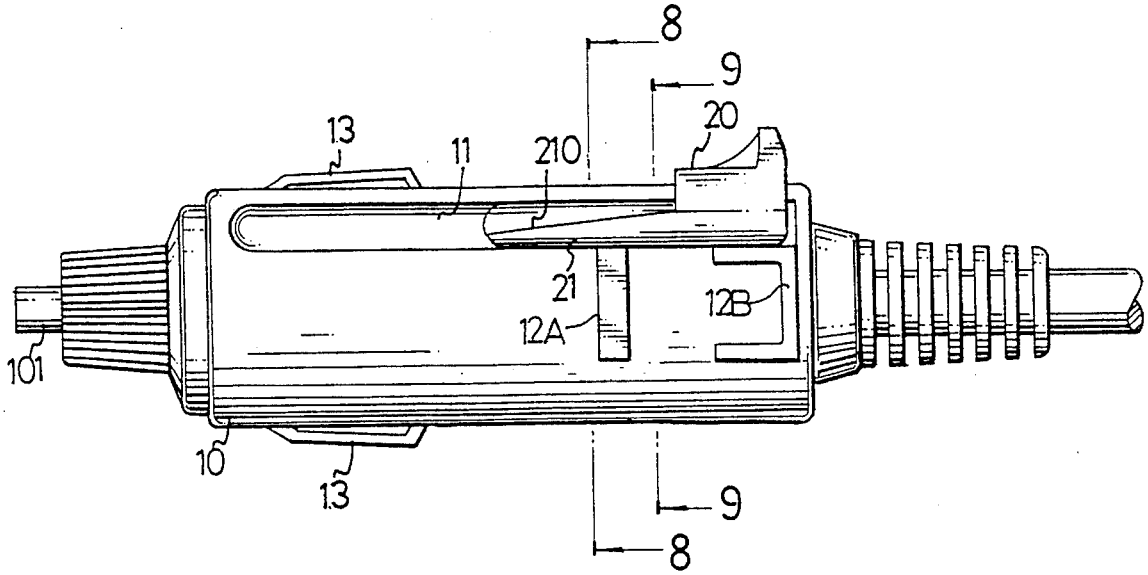
FIG. 7 is a side view of a second embodiment present invention.
Figure 9:
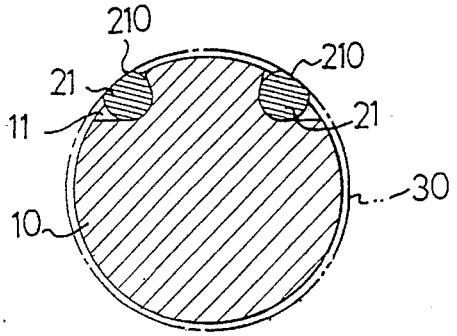
Figure 8:
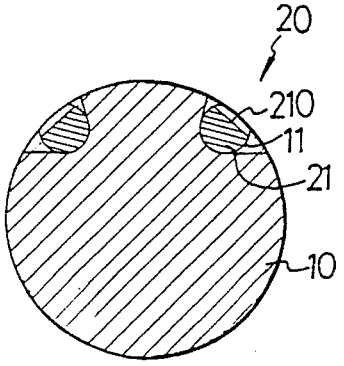
FIG. 8 is a cross-sectional view of the car cigarette lighter taken from a line 8—8 of FIG. 7; and of the FIG. 9 is a schematic cross-sectional view of the car cigarette lighter received in an electrical socket taken from a line 9—9 of FIG. 7.

The car cigarette lighter of the present invention may have an alternative embodiment, where the numbers of the grooves 11 and the ridges 11A are decreased from four to two and the wings 13, the first protrusions 12A, and the second protrusions 12B are formed on the two ridges 11A. The second embodiment is similar to the first embodiment and is illustrated in FIGS. 7,8, and 9.

I claim:

1. A car cigarette lighter suitable to be received in different sizes of sockets each of which includes a positive pole and a negative pole therein, the car cigarette lighter comprising:

a cylinder body;

a neck extending from the cylinder body;

a head extending from the neck;

four elongated grooves and four elongated ridges alternately disposed with each other in a periphery of the cylinder body;

two elastic wings being formed at two opposite ridges;

two U-shaped engaging means each including a pair of prongs received in a corresponding rear section of a corresponding elongated groove and leaving a front section of the groove free, each U-shaped engaging mean being slidable along the corresponding pair of elongated grooves, each prong of the U-shaped engaging means having a tapering surface which has a front portion totally received in the elongated groove and a rear portion not totally received in the groove;

whereby the lighter is inserted into the socket causing the head and the wings thereof to be respectively in electrical contact with the positive pole and the negative pole of the socket, and the U-shaped engaging means are pushed into the socket with the rear portion of the tapering surface of each prong being firmly engaged with the socket.

2. The car cigarette lighter as claimed in claim 1 further comprising a first protrusion and a second protrusion formed at other two ridges near a rear end of the cylinder body thus defining a handle position between the first protrusion and the second protrusion allowing a user to hold thereon to insert the lighter into the socket.

3. A car cigarette lighter suitable to be received in different sizes of sockets each of which includes a positive pole and a negative pole therein, the car cigarette lighter comprising:

a cylinder body;

a neck extending from the cylinder body;

a head extending from the neck;

two elongated grooves and two elongated ridges alternately disposed with each other in a periphery of the cylinder body;

two elastic wings being formed at the two ridges;

a U-shaped engaging means including a pair of prongs each of which is received in a rear section of a corresponding elongated groove and leaving a front section of the groove free, the U-shaped engaging mean being slidable along the elongated grooves, each prong of the U-shaped engaging means having a tapering surface which has a front portion totally received in the elongated groove and a rear portion not totally received in the groove;

whereby the lighter is inserted into the socket causing the head and the wings thereof to be respectively in electrical contact with the positive pole and the negative pole of the socket, and the U-shaped engaging means are pushed into the socket with the rear portion of the tapering surface of each prong being firmly engaged with the socket.

4. The car cigarette lighter as claimed in claim 3 further comprising a first protrusion and a second protrusion formed at the two ridges near a rear end of the cylinder body thus defining a handle position between the first protrusion and the second protrusion allowing a user to hold thereon to insert the lighter into the socket.

* * * * *